US006665967B1

(12) United States Patent
Quackenbush

(10) Patent No.: US 6,665,967 B1
(45) Date of Patent: Dec. 23, 2003

(54) CONVERTIBLE MESSAGE SIGN

(76) Inventor: Ted Quackenbush, 3318 Arbor Rd., Lakewood, CA (US) 90712

( * ) Notice: Subject to any disclaimer, the term of this patent is extended or adjusted under 35 U.S.C. 154(b) by 0 days.

(21) Appl. No.: 10/189,997

(22) Filed: Jul. 3, 2002

Related U.S. Application Data

(63) Continuation-in-part of application No. 09/523,118, filed on Mar. 10, 2000, now abandoned.

(51) Int. Cl.[7] ..... G09F 21/04

(52) U.S. Cl. ..... 40/588; 40/590; 40/618; 40/611.01; 40/611.12

(58) Field of Search ..... 40/492, 611, 612, 40/618, 625, 631, 588, 590, 661.06

(56) References Cited

U.S. PATENT DOCUMENTS

| | | | | | |
|---|---|---|---|---|---|
| 1,082,155 | A | * | 12/1913 | Herbst et al. | 40/5 |
| 1,559,605 | A | | 11/1925 | Ginger | |
| 1,584,627 | A | * | 5/1926 | Marino | 434/159 |
| 1,685,080 | A | | 9/1928 | Auchincloss | |
| 1,727,336 | A | * | 9/1929 | Cooper | 40/588 |
| 1,880,099 | A | | 9/1932 | Marsh | |
| 3,455,044 | A | * | 7/1969 | Falconbridge et al. | 40/591 |
| 3,481,059 | A | * | 12/1969 | Lowmaster | 40/643 |
| 3,481,060 | A | | 12/1969 | Hartz | |
| 3,496,666 | A | * | 2/1970 | Morley | 40/591 |
| 3,518,782 | A | | 7/1970 | Long | |
| 3,535,807 | A | * | 10/1970 | Baldwin | 40/618 |
| 3,903,629 | A | * | 9/1975 | Gruna | 40/591 |
| 4,058,918 | A | | 11/1977 | Fund | |
| 4,094,083 | A | | 6/1978 | Fund | |
| 4,106,229 | A | | 8/1978 | Schmid | |
| 4,134,437 | A | * | 1/1979 | Finn | 150/138 |
| 4,178,710 | A | * | 12/1979 | Schmid | 40/530 |
| 4,801,918 | A | * | 1/1989 | Buckingham et al. | 340/908.1 |
| 4,876,812 | A | * | 10/1989 | Haralson | 40/592 |
| 4,999,938 | A | | 3/1991 | Behling | |
| 5,058,299 | A | | 10/1991 | Suzuki | |
| 5,239,765 | A | | 8/1993 | Opdahl | |
| 5,355,117 | A | | 10/1994 | Jefferson | |
| D359,253 | S | | 6/1995 | Luttrull et al. | |
| 5,657,566 | A | | 8/1997 | Key | |
| 5,954,445 | A | * | 9/1999 | Deutschmann et al. | 402/79 |

* cited by examiner

*Primary Examiner*—Lynne H. Browne
*Assistant Examiner*—James M. Hewitt

(57) ABSTRACT

A convertible message sign for indicating the docking status of a vehicle. The convertible message sign includes a mounting plate for mounting on the vehicle and having a front surface, a back surface, a top edge, a bottom edge, a first side edge and a second side edge. The front surface of the mounting plate has two sections. A plurality of placards are pivotally mounted on the mounting plate such that each of the placards pivots about a substantially common axis and is alternately positionable in front of one of the sections of the front surface. Each of the placards has a status indicia marked thereon. Each of the placards has a front side and a back side, and at least one of the front and back sides of each of the placards has one of the status indicia marked thereon. Each of the status indicia includes a single character.

17 Claims, 3 Drawing Sheets

CONVERTIBLE MESSAGE SIGN

REFERENCE TO RELATED APPLICATION

This application is a continuation-in-part of application Ser. No. 09/523,118, filed Mar. 10, 2000, now abandoned.

BACKGROUND OF THE INVENTION

1. Field of the Invention

The present invention relates to sign devices and more particularly pertains to a new convertible message sign for indicating the docking status of a semi-trailer and the like.

2. Description of the Prior Art

The use of sign devices is known in the prior art. More specifically, sign devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,058,299; 5,657,566; 5,239,765; 5,355,117; U.S. Design Pat. No. 359,253; U.S. Pat. Nos. 4,999,938; and 1,880,099.

Typically, the prior art devices have surfaces with one or more words printed thereon for conveying information about a vehicle on which the device is mounted. However, the use of one or more words on the devices results in the letters of the words being relatively small and difficult to read from a distance, especially if the maximum dimensions of the devices are to be kept to a minimum for weight and aesthetic purposes. It is believed that the usage of one or more words on the display surfaces of the prior art devices thus reduces the distances from which the information on the device can be conveyed, and thus impairs the ability of the prior art devices to quickly and easily convey information.

Further, many of the prior art references teach sign devices that are employed for the purpose of indicating the presence of hazardous materials in a vehicle. Such sign devices do not offer any indication of the destination status of a vehicle bearing these sign devices, and would not be of any assistance to controllers for purposes of controlling traffic and movement of the vehicles. Thus, there is a need for a device that gives assistance to controllers of loading and unloading stations in a readily visible manner over relatively large distances, to permit a quick visual check by the controller to confirm the location and placement of a vehicle to a controller who has to coordinate a plurality of vehicles in a loading/unloading zone.

While the devices of the prior art fulfill their respective, particular objectives and requirements, the aforementioned patents do not disclose a new convertible message sign of the invention. The convertible message sign according to the present invention substantially departs from the conventional concepts and designs of the prior art, and in so doing provides an apparatus primarily developed for the purpose of indicating the docking status of a semi-trailer and the like.

SUMMARY OF THE INVENTION

In view of the foregoing disadvantages inherent in the known types of sign devices now present in the prior art, the present invention provides a new convertible message sign construction wherein the same can be utilized for indicating the docking status of a semi-trailer and the like.

The general purpose of the present invention, which will be described subsequently in greater detail, is to provide a new convertible message sign apparatus and method which has many of the advantages of the sign devices mentioned heretofore and many novel features that result in a new convertible message sign which is not anticipated, rendered obvious, suggested, or even implied by any of the prior art sign devices, either alone or in any combination thereof.

To attain this, the present invention generally comprises a mounting plate for mounting on the vehicle and having a front surface, a back surface, a top edge, a bottom edge, a first side edge and a second side edge. The front surface of the mounting plate has two sections. A plurality of placards are pivotally mounted on the mounting plate such that each of the placards pivots about a substantially common axis and is alternately positionable in front of one of the sections of the front surface. Each of the placards has a status indicia marked thereon. Each of the placards has a front side and a back side, and at least one of the front and back sides of each of the placards has one of the status indicia marked thereon. Each of the status indicia comprises a single character.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new convertible message sign apparatus and method which has many of the advantages of the sign devices mentioned heretofore and many novel features that result in a new convertible message sign which is not anticipated, rendered obvious, suggested, or even implied by any of the prior art sign devices, either alone or in any combination thereof.

It is another object of the present invention to provide a new convertible message sign which may be easily and efficiently manufactured and marketed.

It is a further object of the present invention to provide a new convertible message sign which is of a durable and reliable construction.

An even further object of the present invention is to provide a new convertible message sign which is susceptible of a low cost of manufacture with regard to both materials and labor, and which accordingly is then susceptible of low prices of sale to the consuming public, thereby making such convertible message sign economically available to the buying public.

Still yet another object of the present invention is to provide a new convertible message sign which provides in the apparatuses and methods of the prior art some of the advantages thereof, while simultaneously overcoming some of the disadvantages normally associated therewith.

Still another object of the present invention is to provide a new convertible message sign for indicating the docking status of a semi-trailer and the like.

Yet another object of the present invention is to provide a new convertible message sign which includes a mounting plate for mounting on the vehicle and having a front surface, a back surface, a top edge, a bottom edge, a first side edge and a second side edge. The front surface of the mounting plate has two sections. A plurality of placards are pivotally mounted on the mounting plate such that each of the placards pivots about a substantially common axis and is alternately positionable in front of one of the sections of the front surface. Each of the placards has a status indicia marked thereon. Each of the placards has a front side and a back side, and at least one of the front and back sides of each of the placards has one of the status indicia marked thereon. Each of the status indicia comprises a single character.

Still yet another object of the present invention is to provide a new convertible message sign that easily and efficiently conveys the docking status of the trailer to dock workers and the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
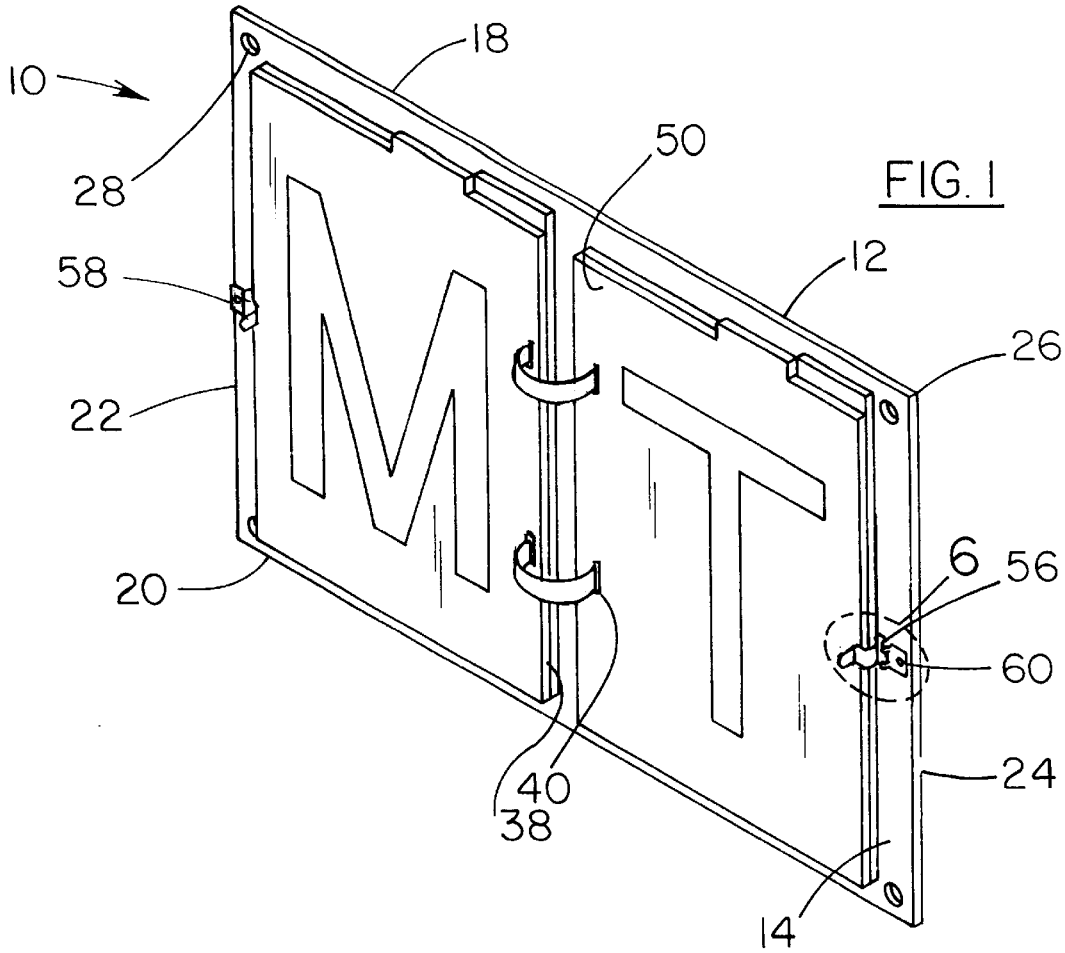
FIG. 1 is a schematic perspective view of a new convertible message sign according to the present invention.
Figure 2:
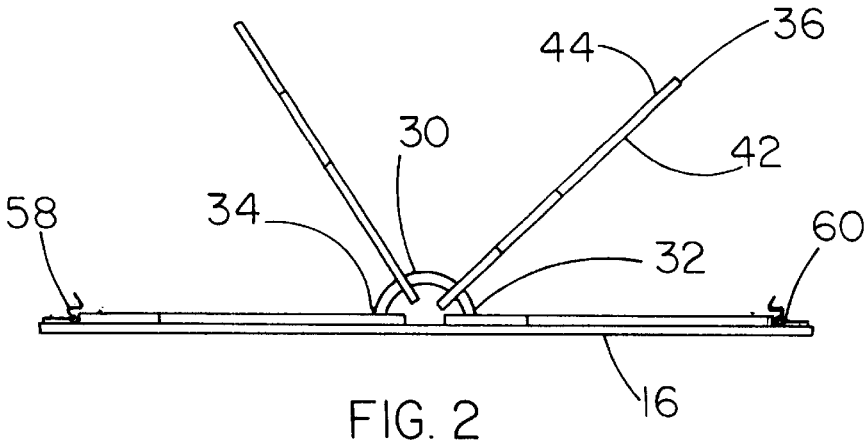
FIG. 2 is a schematic side view of the present invention.
Figure 3:
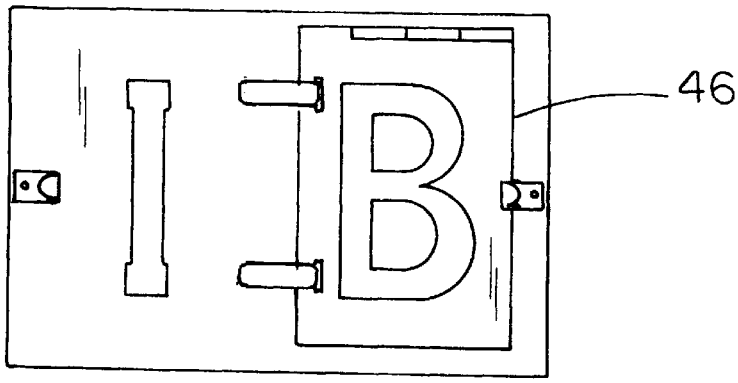
FIG. 3 is a schematic plan view of the present invention.
Figure 4:
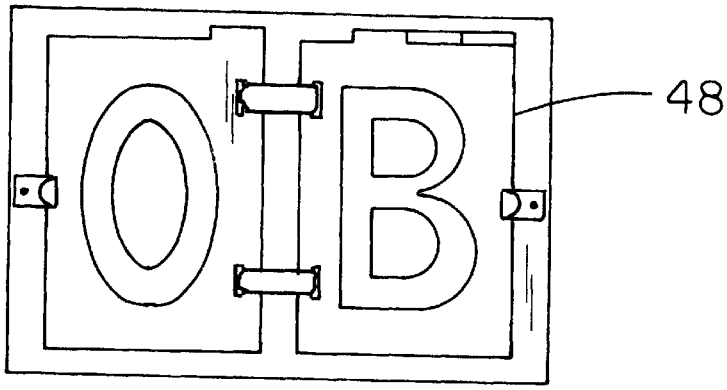
FIG. 4 is a schematic plan view of the present invention.
Figure 5:
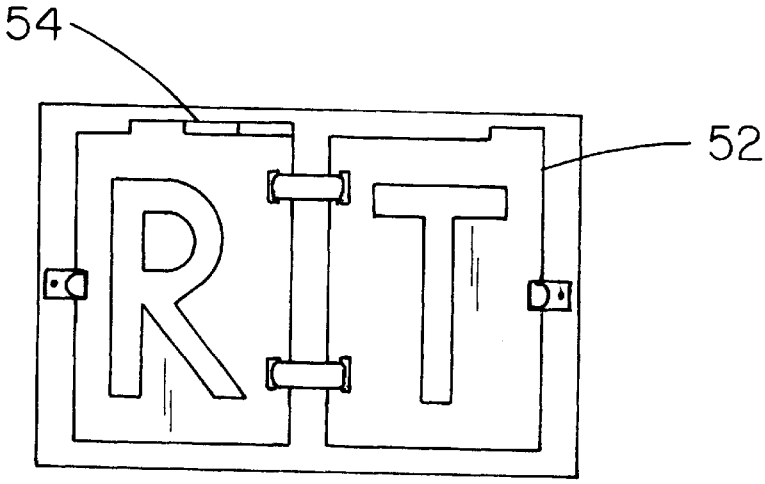
FIG. 5 is a schematic plan view of the present invention.
Figure 6:
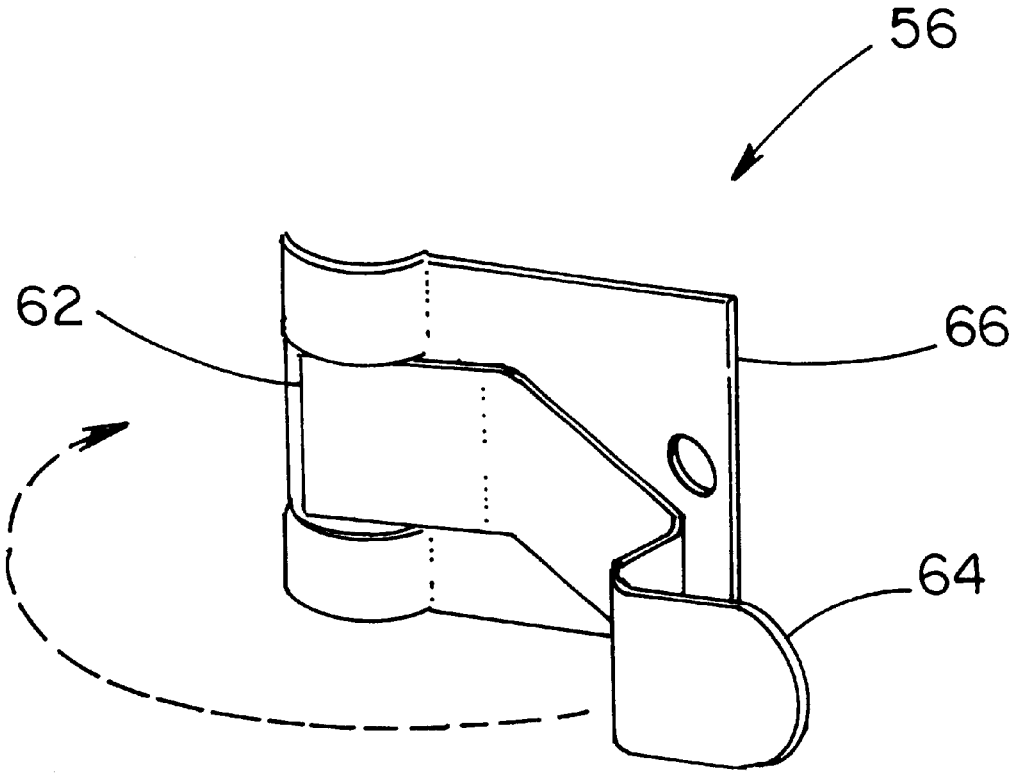
FIG. 6 is a schematic perspective view of the clasp of the present invention.

With reference now to the drawings, and in particular to FIGS. 1 through 6 thereof, a new convertible message sign embodying the principles and concepts of the present invention and generally designated by the reference numeral 10 will be described.

As best illustrated in FIGS. 1 through 6, the convertible message sign 10 generally comprises a mounting plate 12 for mounting on the semi-trailer. The mounting plate 12 has a front surface 14, a back surface 16, a top edge 18, a bottom edge 20, a first side 22 and a second side 24. The mounting plate 12 has four corners 26. The mounting plate 12 has a bore 28 generally adjacent to each of the corners 26. The mounting plate 12 has a generally rectangular shape.

Two hinges 30 are each generally hemi-cylindrical. Each of the hinges 30 has a first end 32 and a second end 34. Each of the first 32 and second ends 34 of the hinges 30 is fixedly coupled to the front surface 14 of the mounting plate 12. Each of a half loop of the hinges 30 defines a plane. Each of the planes of the hinges 30 is orientated generally parallel to the top edge 18 of the mounting plate 12. Each of the half loops has a radius located generally along a line oriented generally perpendicular to and bisecting the top edge 18 of the mounting plate 12. The hinges are spaced.

A plurality of placards 36 for mounting on the hinges 30 has a front side 42 and a back side 44. Each of the placards 36 has a peripheral edge 38 and a pair of slots 40 therein. Each of the slots 40 is located generally adjacent to the peripheral edge 38 and adjacent to a left edge of the front side 42 of the placards 36. The slots 40 are located to coincide with the hinges 30. The placards 36 are hingedly coupled to the hinges 30. Each of the placards 36 has indicia thereon. A first 46 of the placards 36 has a letter B indicia on the front side and has a letter O indicia on the back side. A second 48 of the placards has a letter B indicia on a front side and a letter M indicia on the back side. A third 50 of the placards has a letter T indicia the front side and letter R indicia on the back side. A fourth 52 of the placards has a letter T indicia on the front side. Each of the placards 36 is generally rectangular shaped.

A letter I indicia is on the front surface 14 of the mounting plate 12. The letter I indicia is between the first edge 22 of the mounting plate and the hinges 30.

The placards 36 are pivotally mounted on the hinges 30 and are consecutively stacked such that the first placard 46 is on top with the first side 42 exposed.

A plurality of tabs 54 for turning the placards 36 is integrally coupled to one of the top edges of the placards 36. The tabs 54 are staggered such that all of the tabs 54 are visible.

A pair of securing means 56 holds the placards 36 in an abutted position against the mounting plate 12. A first 58 of the securing means is generally adjacent to the first edge 22 of the mounting plate 12. A second 60 of the securing means is generally adjacent to the second edge 24 of the mounting plate 12. Each of the securing means 56 is mounted to the front surface 14 of the mounting plate 12. Each of the securing means 56 has a first end 62 and a second end 64 and each of the first ends 62 is hingedly coupled to a base plate 66. The securing means 56 have a spring therein, not shown, adapted to urge the second end 64 of the securing means 56 toward the mounting plate 12. Each of the securing means 56 is a clasp.

A plurality of fastening means, not shown, fasten the mounting plate 12 to the semi-trailer. Each of the fastening means extends through one of the bores 28 and into the semi-trailer. Each of the fastening means is a bolt.

In use, the placards 36 are turned to illustrate to people in a warehouse or other similar facility what the status is of the semi-trailer. "IB" indicates inbound. "OB" indicates outbound. "RT" indicates red-flag. "MT" indicates the trailer is empty.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible message sign device mountable to a vehicle for conveying a status of the vehicle to a person located at a remote distance from the vehicle, the device comprising:

a mounting plate for mounting on the vehicle, the mounting plate having a front surface, a back surface, a top edge, a bottom edge, a first side edge and a second side edge, the front surface of the mounting plate having two sections; and a plurality of placards pivotally mounted on the mounting plate such that each of the placards pivots about a substantially common axis and is alternately positionable in front of one of the sections of the front surface of the mounting plate, each of the placards having a status indicia marked thereon, each of the placards having a front side and a back side, at least one of the front and back sides of each of the placards having one of the status indicia marked thereon, each of the status indicia consisting of a single character.

2. The device of claim 1 wherein the character of the status indicia comprises a letter of the alphabet.

3. The device of claim 1 wherein each character on the placards has a height that is greater than half a height of the placard on which the character is marked and a width that is greater than half a width of the placard on which the character is marked.

4. The device of claim 3 wherein the height of each character is between approximately one-half and three-quarters of the height of the placard on which the character is marked and the width of each character is between approximately one-half and three-quarters of the width of the placard on which the character is marked.

5. The device of claim 1 wherein both of the front and back sides of the placards have one of the status indicia marked thereon.

6. The device of claim 1 wherein a first one of the placards has a letter B indicia marked on the front side and has a letter O indicia on the back side.

7. The device of claim 6 wherein a second one of the placards has a letter B indicia marked on a front side and a letter M indicia marked on the back side.

8. The device of claim 7 wherein a third one of the placards has a letter T indicia marked on the front side and letter R indicia marked on the back side.

9. The device of claim 8 wherein a fourth one of the placards has a letter T indicia marked on the front side.

10. The device of claim 1 wherein a letter I indicia is marked on the front surface of the mounting plate on one of the sections of the mounting plate.

11. The device of claim 1 additionally comprising a pair of hinges, each of the hinges having a first end and a second end, each of the first and second ends of the hinges being coupled to the front surface of the mounting plate, each of the hinges comprising a half loop, the placards being pivotally mounted on the hinges.

12. The device of claim 11 wherein each of the placards has a peripheral edge, each of the placards having a pair of slots therein, each of the slots being located generally adjacent to the peripheral edge, each of the hinges extending through one of the slots of each of the placards.

13. The device of claim 1 additionally comprising a plurality of tabs each extending from one of the placards for facilitating turning of the placards.

14. The device of claim 13 wherein each of the tabs is integrally coupled to a top edge of one of the placards, the tabs being staggered in position along the top edges of the placards such that all of the tabs are visible when the placards are stacked on each other.

15. The device of claim 1 additionally comprising a pair of securing means for holding the placards in an abutted position against the mounting plate, a first of the securing means being generally adjacent to the first side edge of the mounting plate, a second of the securing means being generally adjacent to the second side edge of the mounting plate.

16. The device of claim 1 additionally comprising a plurality of fastening means for fastening the mounting plate to the vehicle, each of the fastening means extending through a bore in the mounting plate.

17. A convertible message sign device mountable to a vehicle for conveying a status of the vehicle to a person located at a remote distance from the vehicle, the device comprising:

a mounting plate for mounting on the vehicle, the mounting plate having a front surface, a back surface, a top edge, a bottom edge, a first side edge and a second side edge, the front surface of the mounting plate having two sections;

wherein the mounting plate has four corners, a plurality of mounting bores formed in the mounting plate for receiving fasteners to mount the mounting plate on the vehicle, each of the bores being generally adjacent to one of the corners, the mounting plate having a generally rectangular shape;

a plurality of placards pivotally mounted on the mounting plate such that each of the placards pivots about a substantially common axis and is alternately positionable in front of one of the sections of the front surface of the mounting plate, each of the placards having a status indicia marked thereon, each of the placards having a front side and a back side, at least one of the front and back sides of each of the placards having one of the status indicia marked thereon, each of the status indicia comprising a single character;

wherein the character of the status indicia comprises a letter of the alphabet;

wherein each letter on the placards has a height that is greater than half a height of the placard on which the letter is marked and a width that is greater than half a width of the placard on which the letter is marked;

wherein the height of each letter is between approximately one-half and three-quarters of the height of the placard on which the character is marked and the width of each letter is between approximately one-half and three-quarters of the width of the placard on which the character is marked;

wherein both of the front and back sides of the placards on which the character is marked have one of the status indicia marked thereon, wherein each of the placards has a peripheral edge, each of the placards having a pair of slots therein, each of the slots being located generally adjacent to the peripheral edge, each of the slots being generally adjacent to a left edge of the front side of each of the placards;

a pair of hinges, each of the hinges being generally hemi-cylindrical, each of the hinges having a first end and a second end, each of the first and second ends of the hinges being coupled to the front surface of the mounting plate, each of the hinges comprising a half loop, each of the hinges lying in substantially parallel planes with respect to each other, the hinges being spaced from each other, the placards being pivotally mounted on the hinges, wherein the placards are consecutively stacked such that the first placard is on top with the front side exposed;

a first one of the placards having a letter B indicia marked on the front side and having a letter O indicia marked on the back side, a second one of the placards having a letter B indicia marked on the front side and a letter M indicia marked on the back side, a third one of the placards having a letter T indicia marked on the front side and letter R indicia marked on the back side, a fourth one of the placards having a letter T indicia marked on the front side, each of the placards being generally rectangular shaped, a letter I indicia being marked on the front surface of the mounting plate, the letter I indicia being between the first side edge of the mounting plate and the hinges;

a plurality of tabs each extending from one of the placards for facilitating turning of the placards, each of the tabs being integrally coupled to a top edge of one of the placards, the tabs being staggered in position along the top edges of the placards such that all of the tabs are visible when the placards are stacked on each other;

a pair of securing means for holding the placards in an abutted position against the mounting plate, a first of the securing means being generally adjacent to the first side edge of the mounting plate, a second of the securing means being generally adjacent to the second side edge of the mounting plate, each of the securing means being mounted to the front surface of the mounting plate, each of the securing means having a first end and a second end, each of the first ends being hingedly coupled to a base plate, each of the securing means having a spring therein adapted to urge the second end of the securing means toward the mounting plate, each of the securing means being a clasp; and a plurality of fastening means for fastening the mounting plate to the vehicle, each of the fastening means extending through one of the bores and into the vehicle, each of the fastening means being a bolt.

* * * * *